US007259528B2

(12) United States Patent
Pilz

(10) Patent No.: US 7,259,528 B2
(45) Date of Patent: Aug. 21, 2007

(54) DATA CONVERTER FOR A LIGHTING SYSTEM, AND METHOD FOR OPERATING A LIGHTING SYSTEM

(75) Inventor: Axel Pilz, Neuenstein (DE)

(73) Assignee: Patent-Treuhand-Gesellschaft für Elektrische Glühlampen mbH

( * ) Notice: Subject to any disclaimer, the term of this patent is extended or adjusted under 35 U.S.C. 154(b) by 0 days.

(21) Appl. No.: 10/939,350

(22) Filed: Sep. 14, 2004

(65) Prior Publication Data

US 2005/0067982 A1 Mar. 31, 2005

(30) Foreign Application Priority Data

Sep. 29, 2003 (DE) ..... 103 45 611

(51) Int. Cl.

| | |
|---|---|
| ***H05B 41/36*** | (2006.01) |
| ***H05B 39/04*** | (2006.01) |
| ***H05B 37/02*** | (2006.01) |
| ***G05F 1/00*** | (2006.01) |

(52) U.S. Cl. ..... 315/294; 315/292; 700/90

(58) Field of Classification Search ..... 315/291–295, 315/312, 314, 316, 318, 324, 362; 700/17, 700/90

See application file for complete search history.

(56) References Cited

U.S. PATENT DOCUMENTS

| | | | | |
|---|---|---|---|---|
| 5,471,119 | A * | 11/1995 | Ranganath et al. | 315/307 |
| 5,544,037 | A * | 8/1996 | Luger | 700/17 |
| 6,072,283 | A * | 6/2000 | Hedrei et al. | 315/307 |
| 6,326,741 | B1 * | 12/2001 | Hunt et al. | 315/316 |
| 6,507,158 | B1 | 1/2003 | Wang | |
| 6,577,080 | B2 * | 6/2003 | Lys et al. | 315/362 |
| 6,597,132 | B2 * | 7/2003 | Hunt et al. | 315/316 |
| 6,894,443 | B2 * | 5/2005 | Hunt et al. | 315/312 |
| 7,135,824 | B2 * | 11/2006 | Lys et al. | 315/292 |
| 2002/0070689 | A1 * | 6/2002 | Hunt et al. | 315/312 |
| 2002/0171379 | A1 * | 11/2002 | Adamson | 315/312 |
| 2003/0030384 | A1 | 2/2003 | Huber et al. | |
| 2004/0160199 | A1 * | 8/2004 | Morgan et al. | 315/312 |

* cited by examiner

*Primary Examiner*—Don Wong
*Assistant Examiner*—Hung Tran Vy
(74) *Attorney, Agent, or Firm*—Carlo S. Bessone

(57) ABSTRACT

A data converter for a lighting system, has a data input for the data converter to communicate with a central control device of the lighting system, a data output for the data converter to communicate with lamp operating elements, and an evaluation unit for evaluating the data received from the central control device and for controlling and monitoring the functions of the lamp operating elements. The data converter permits an enlargement of the number of the lamp operating elements, in the lighting system, that can be monitored by the central control device.

11 Claims, 2 Drawing Sheets

DATA CONVERTER FOR A LIGHTING SYSTEM, AND METHOD FOR OPERATING A LIGHTING SYSTEM

I. TECHNICAL FIELD

Figure 1:
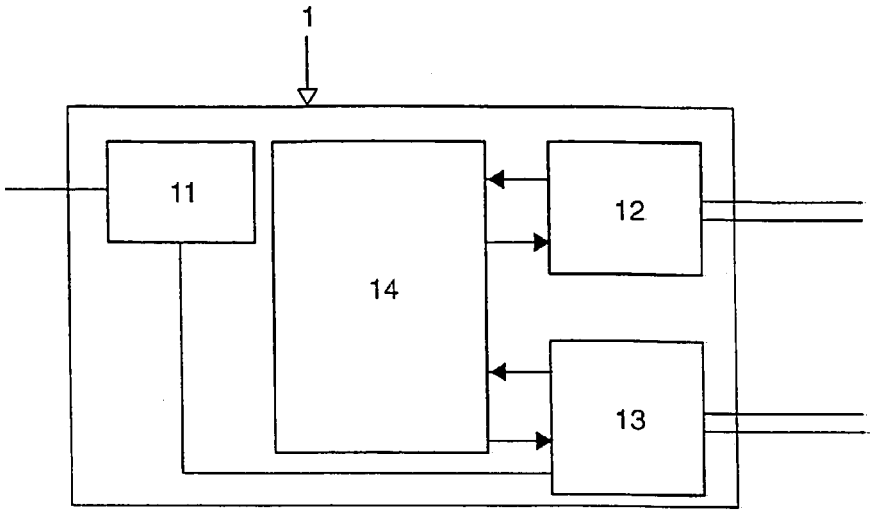

The invention relates to a data converter for a lighting system and to an operating method for a lighting system.

II. BACKGROUND ART

Laid-open application WO 02/41671 A2 describes a lighting system having a number of lamp operating means and a central control device for the lamp operating means, the lamp operating means having addressable interfaces via which digital data are communicated to the central control device. This communication is performed in accordance with the standardized so-called DALI protocol. The abbreviation DALI stands for Digital Addressable Lighting-Interface.

A disadvantage of the lighting systems whose central control devices communicate with the lamp operating means in accordance with the DALI protocol is that their address store is limited to sixty-four individual addresses and sixteen group addresses. Moreover, the maximum current carrying capacity of the interface of the central control device is only 250 mA. The maximum number of the lamp operating means that can be connected to the central control device is thereby correspondingly limited.

III. DISCLOSURE OF THE INVENTION

It is the object of the invention to provide a device and method that avoid the abovenamed disadvantage of the control devices of lighting systems that communicate with the lamp operating means in accordance with the DALI protocol.

This object is achieved according to the invention by a data converter for a lighting system, having a data input for the data converter to communicate with a central control device of the lighting system, a data output for the data converter to communicate with lamp operating means, and an evaluation unit for evaluating the data received from the central control device and for controlling and monitoring the functions of the lamp operating means. Particularly advantageous designs of the invention are described in the dependent patent claims.

The device according to the invention, which is denoted here as a data converter, has a data input for the data converter to communicate with a central control device of the lighting system, a data output for the data converter to communicate with lamp operating means, and an evaluation unit for evaluating the data received from the central control device and for controlling and monitoring the functions of the lamp operating means. The lamp operating means are, for example, electronic ballasts for low-pressure or high-pressure discharge lamps, transformers for operating low-voltage halogen incandescent lamps, or driver circuits for light-emitting diodes. The term lamps is used below to represent all types of electrically operated lighting means.

Via its data input, the data converter according to the invention can be controlled by the central control device in the same way as a lamp operating means. This means, in particular, that the data converter according to the invention can be subjected by the central control device to the same control signals as the lamp operating means controlled directly by the central control device. The evaluation unit of the data converter converts these control signals of the central control device into commands for controlling the lamp operating means controlled by the data converter. The data converter according to the invention behaves toward the central control device like a single lamp operating means with regard to addressing and control. On the other hand, however, the data output of the data converter according to the invention is designed in such a way that commands can be relayed via this data output to a large number of lamp operating means for controlling and monitoring their functions, these commands being generated by the evaluation unit of the data converter according to the invention as a function of the control signals of the central control device. It is possible in this way to enlarge the number of the lamp operating means in the lighting system whose function can be controlled by means of the central control device. The maximum permissible interface current of the central control device is not exceeded, since the data converter according to the invention behaves toward the central control device like a lamp operating means, and itself provides at its data output the interface current for the lamp operating means controlled by the data converter.

In order to permit in the data converter the storage of an address code assigned by the central control device, the data converter advantageously has a nonvolatile storing means. The data input of the data converter is preferably designed as a multifunctional input that can receive both digital and analog control signals that are converted by the evaluation unit of the data converter into commands for the lamp operating means controlled by it, as has been described, for example, in the laid-open specification WO 01/52607 A1. The data converter according to the invention is thereby not only compatible with a central control device that communicates in accordance with the standardized DALI protocol, but in the simplest case the central control device can even be a pushbutton.

In order to be able to use the data converter according to the invention in the most universal way possible, it is advantageously designed such that it can be switched over between at least-two different operating modes.

In accordance with the method according to the invention for operating a lighting system that has a number of lamp operating means and a central control device for the lamp operating means, at least some of the lamp operating means are monitored and controlled by means of a data converter that receives and evaluates control signals generated by the central control device and converts them as a function of the result of the evaluation into commands for controlling the lamp operating means monitored by the data converter. As has already been mentioned above, it is possible thereby to enlarge the number of the lamp operating means in the lighting system whose function can be controlled by means of the central control device.

For the data converter according to the invention, at least two different operating modes are advantageously provided in order to be able to use it universally. In accordance with a first preferred operating mode, the evaluation unit of the data converter converts the control signals received from the central control device into similar commands for all the lamp operating means monitored by the data converter. In this operating mode, all the lamp operating means monitored by the data converter are controlled in the same way, that is to say the associated lamps can be switched on and off and dimmed simultaneously. As a result, the abovenamed lamp operating means and their lamps are automatically combined into a group. A particular advantage of this operating mode consists in that, instead of a central control device that communicates in accordance with the standardized DALI protocol, it is also possible to use a pushbutton as central control device in order to control the data converter and the lamp operating means monitored by it, since the data converter according to the invention can preferably receive and evaluate both digital and analog control signals.

In accordance with a second preferred operating mode of the data converter, the control signals output by the central control device are received and evaluated by the lamp operating means via the data converter, in accordance with a group membership of the lamp operating means monitored by the data converter. The second operating mode permits the expansion of the grouping of the lamp operating means to a larger number of lamp operating means than could be operated solely with the aid of the central control device.

In order, in a simple way and without enlarging the address store of the central control device, to permit the abovenamed expansion of the grouping to the lamp operating means controlled by the data converter, first of all during the start-up phase of the lighting system a start-up procedure of the data converter is advantageously started in order to provide address codes to the lamp operating means monitored by the data converter, and subsequently a start-up procedure of the central control device is started in order to provide address codes to the data converter and any possible lamp operating means directly monitored by the central control device, the data converter being selected by the central control device, for the purpose of grouping the lamp operating means monitored by the data converter, until all the lamp operating means monitored by the data converter are divided into groups, and upon each selection by the data converter a lamp operating means monitored by the data converter being successively assigned to a group of lamp operating means. It is thereby possible, despite the restricted address store of the central control device, to expand the grouping of the lamp operating means to the lamp operating means controlled by the data converter. In particular, it is possible thereby for lamp operating means that are controlled directly by the central control device to be combined with lamp operating means that are controlled by the data converter in a group of lamp operating means to be driven jointly.

The evaluation unit of the data converter according to the invention preferably comprises a microcontroller in order to permit program-controlled evaluation of the control signals received from a central control device, as well as to permit monitoring of the lamp operating means connected to the data output of the data converter. The data converter advantageously carries out automatic status monitoring of the lamp operating means connected to its data output. This ensures that malfunctions can be detected even in the case of the lamp operating means controlled by the data converter, although the data converter receives from the central control device only the same control signals as does each lamp operating means connected directly to the central control device. The data converter advantageously answers queries from the central control device concerning the status of the lamp operating means for the lamp operating means connected to the data output of the data converter, in order to ensure that the acknowledgement to the central control device takes place within the permissible time window provided for the purpose. The data converter preferably carries out the abovenamed status monitoring cyclically at regular time intervals in order to have the appropriate values ready for queries from the central control device concerning the status of the lamp operating means for the acknowledgement.

The data converter according to the invention is preferably capable of detecting the type of the lamp operating means connected to its data output. As a result, the data converter can evaluate queries from a central control device concerning the properties of the lamp operating means, and can answer them for the lamp operating means controlled by it. The data converter preferably answers queries from a central control device concerning the properties of the lamp operating means for the lamp operating means connected to the data output of the data converter with a prescribed standard value for the respective interrogated property of the lamp operating means when the lamp operating means controlled by the data converter differ from one another with reference to the respective interrogated property. The standard value is advantageously selected such that it is compatible with all types of lamp operating means. This ensures that the central control device does not react with a fault signal because of a missing acknowledgement of its query. When, however, the lamp operating means controlled by the data converter are identical with reference to the respective interrogated property, the abovenamed queries from the central control device for the lamp operating means connected to the data output of the data converter are preferably answered by the data converter with a reference value for the respective interrogated property, the data converter using as reference value the value of the respective interrogated property of a lamp operating means, selected by the data converter, of the lamp operating means connected to its data output. In other words, the data converter selects one of the lamp operating means controlled by it as reference unit for one or more properties, for example for the maximum dimming range, and acknowledges the value thereof for this property or properties to the central control device. In this case, the abovenamed queries from the central control device can be answered correctly by the data converter for the lamp operating means controlled by it.

IV. BRIEF DESCRIPTION OF THE DRAWINGS

Figure 2:
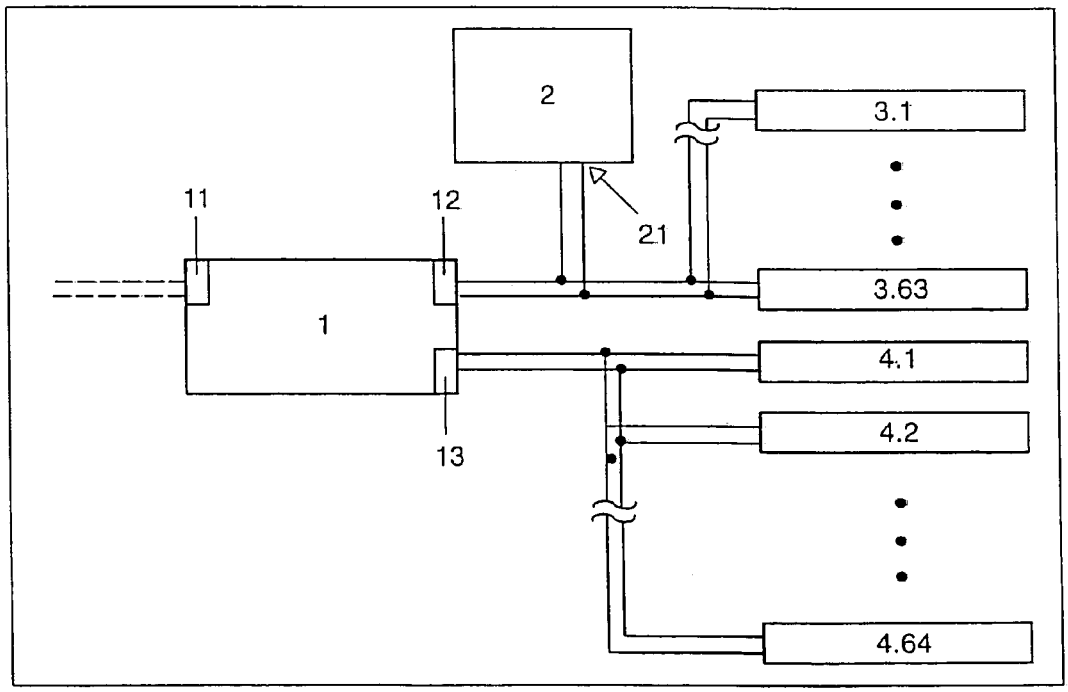
Figure 3:
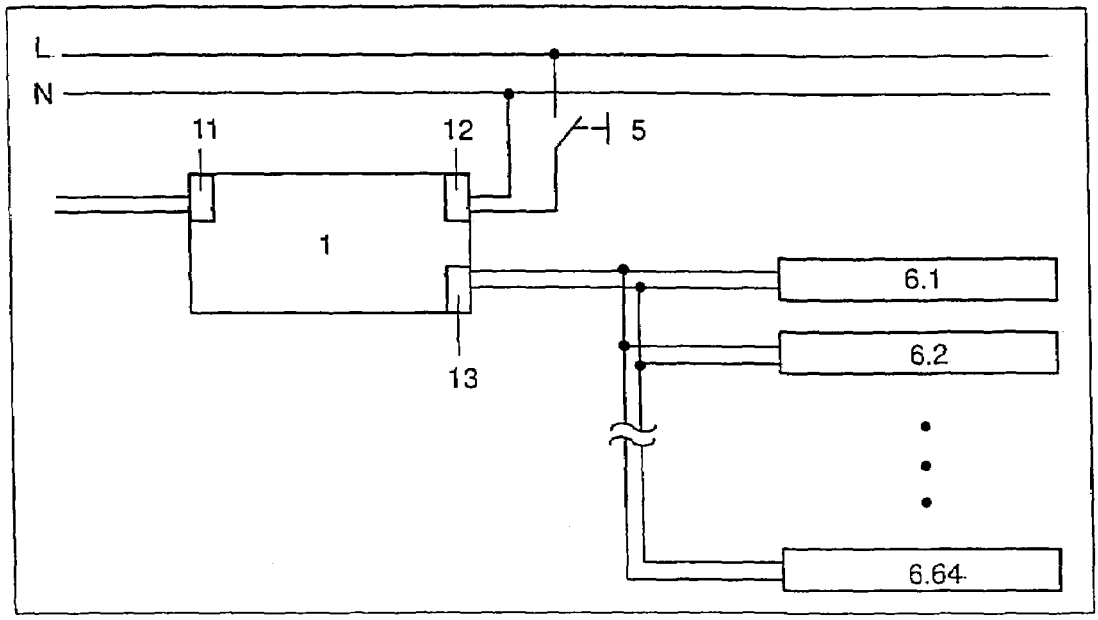

The invention is explained in more detail below with the aid of a preferred exemplary embodiment. In the drawings:

FIG. 1 shows a schematic illustration of the function blocks of the data converter according to the invention, FIG. 2 shows a schematic illustration of a lighting system having the data converter according to the invention and a central control device, and FIG. 3 shows a schematic illustration of a lighting system having the data converter according to the invention and a pushbutton as central control device.

V. BEST MODE FOR CARRYING OUT THE INVENTION

The function blocks of the data converter are depicted schematically in FIG. 1. The data converter 10 has a power supply unit 11 that can be connected to the line voltage, and supplies the data converter with electric energy. Moreover, the data converter 10 has a data input 12 that can be connected to an output of a central control device of a lighting system, and a data output 13 that can be connected to a multiplicity of lamp operating means. The data received at the data input 12 are evaluated by the downstream evaluation unit 14 of the data converter 10, and converted into commands for the lamp operating means connected to the data output 13. The evaluation unit 14 is designed as a programmable microcontroller. Via the data output 13, the power supply unit 11 provides the interface current for the communication with the lamp operating means connected to the data output 13. Both the communication of the data converter 10 with the central control device via the data input 12, and its communication with the lamp operating means connected to the data output 13 are bidirectional.

FIG. 2 shows a schematic illustration of a lighting system having a central control device 2, a data converter 1, first lamp operating means 3.1 to 3.63 and second lamp operating means 4.1 to 4.64. The control output 21 of the central control device 2 is connected via lines to the first lamp operating means 3.1 to 3.63 and to the data converter 1. The first lamp operating means 3.1 to 3.63 and the data converter 1 are connected in parallel. The second lamp operating means 4.1 to 4.64 are connected to the data output 13 of the data converter 1. They are likewise connected in parallel. The first lamp operating means 3.1 to 3.63 are controlled directly by the central control device, while the second lamp operating means 4.1 to 4.64 are controlled by the data converter 1, specifically as a function of the control signals that the data converter 1 receives at its data input 12 from the central control device 1. The lamp operating means 3.1 to 3.63 and 4.1 to 4.64 are ballasts for discharge lamps, transformers for low-voltage halogen incandescent lamps and driver circuits for light-emitting diodes. Consequently, the term lamp subsumes the light-generating means comprising discharge lamp, incandescent lamp and light-emitting diodes. In accordance with the standardized DALI protocol, via its control output 21 the central control device 2 communicates control signals with the sixty-three lamp operating means 3.1 to 3.63 connected thereto, and with the data converter 1. Each of the sixty-three lamp operating means 3.1 to 3.63 and the data converter 1 has an address code from the address store, comprising sixty-four individual addresses, of the central control device 2. Moreover, these lamp operating means 3.1 to 3.63 and the data converter 1 can be assigned group address codes from the group address store, comprising sixteen group addresses, of the central control device 2, in order to combine the individual lamp operating means 3.1 to 3.63 and, if appropriate, the data converter 1 into groups to be driven jointly. The lamp operating means combined in groups, or their light-generating means, are switched on and off and dimmed simultaneously.

Two different operating methods of the lighting system depicted in FIG. 2 schematically are described below; they correspond to two different operating modes of the data converter 1.

In accordance with the first operating mode of the data converter 1, the central control device 2 communicates with the data converter 1 in the same way as the first lamp operating means 3.1 to 3.63. Digital control signals that the data converter 1 receives at its data input 13 from the central control device 2 are evaluated by the evaluation unit 14 of the data converter 1, and converted into digital commands that are communicated via the data output 13 to all sixty-four second lamp operating means 4.1 to 4.64 connected thereto. This means that all the second lamp operating means 4.1 to 4.64 receive the same commands, and their light-generating means can therefore be turned on and off and dimmed only simultaneously. The second lamp operating means 4.1 to 4.64 cannot be addressed and controlled individually, but only as a group. Consequently, the data converter 1 can answer a status interrogation from the central control device 2 for the lamp operating means 4.1 to 4.64 only in a fashion covering a group. In the case of a defective lamp or a defective second lamp operating means 4.1 to 4.64, the data converter 1 will communicate only the occurrence of a defect to the central control device 2, but without being able to establish the number of the defective lamps or lamp operating means 4.1 to 4.64, and being able to locate the defective lamps or lamp operating means 4.1 to 4.64. It is only the first lamp operating means 3.1 to 3.63 connected directly to the central control device 2 that can be addressed and controlled individually.

The advantage of the first operating mode is that no special start-up of the data converter and its downstream lamp operating means 4.1 to 4.64 is required, and the data converter 1 is compatible with all the central control devices with a DALI interface 21. It is disadvantageous that this operating mode does not permit grouping of the lamp operating units 4.1 to 4.64.

In accordance with the second operating mode of the data converter 1, as well, the central control device 2 communicates with the data converter 1 in the same way as with the first lamp operating means 3.1 to 3.63. Digital control signals that are received by the data converter 1 at its data input 13 from the central control device 2 are evaluated by the evaluation unit 14 of the data converter 1, and converted into digital commands that, however, as a rule are not communicated via the data output 13 to all the sixty-four secondary lamp operating means 4.1 to 4.64 connected thereto, but selectively only to some predetermined ones of the sixty-four second lamp operating means 4.1 to 4.64. This means that, by contrast with the abovedescribed first operating mode, the second lamp operating means 4.1 to 4.64 are controlled in accordance with their group membership by the central control device 2 and the data converter 1.

A precondition for dividing the second lamp operating means 4.1 to 4.64 into groups is that, firstly, during a start-up phase the second lamp operating means 4.1 to 4.64 are provided with an address code in order to render them distinguishable to the data converter 1 and the control device 2. Ideally, the start-up is started and carried out automatically without external intervention by the data converter 1 as soon as the data converter 1 detects lamp operating means without an address that are connected to its data output 13. However, this start-up can also alternatively be effected via a pushbutton located on the data converter 1 or via a special command from the central control device. During its start-up, the data converter 1 assigns each of the lamp operating means 4.1 to 4.64 an individual address code from its address store, which is permanently stored by each lamp operating means 4.1 to 4.64. The data converter 1 can distinguish the second lamp operating means 4.1 to 4.64 by this address code. The start-up of the central control device 2 and the lamp operating means 3.1 to 3.63, connected to its control output 21, and of the data converter 1 is effected subsequently. The lamp operating means 3.1 to 3.63 and the data converter 1 are divided into a maximum of sixteen groups in accordance with the available group address store of the central control device 2 by virtue of the fact that the central control device 2 in each case assigns at least one of the sixteen group addresses to each lamp operating means 3.1 to 3.63 and the data converter 1. The acceptance of the respective group address code by the lamp operating means 3.1 to 3.63 and 4.1 to 4.64 can be achieved, for example, by successively equipping the lamp operating means 3.1 to 3.63 and 4.1 to 4.64 in accordance with their group membership, as described, for example, in the Offenlegungsschrift EP 0 639 938 A1. Another, preferred possibility for the group assignment consists in assigning the group addresses to the individual lamp operating means 3.1 to 3.63 and the data converter 1 via the operating elements of the central control device 2. In this case, each lamp operating means 3.1 to 3.63 is selected precisely once by the central control device 2, and is assigned at least one group address with the aid of the operating elements. During the group assignment, the data converter 1 is selected or called sixty-four times by the central control device 2, in accordance with the number of the lamp operating means 4.1 to 4.64 connected to its data output 13. Each time the data converter 1 is called by the central control device 2, at least one group address is successively assigned to one of the lamp operating means 4.1 to 4.64 connected to the data output 13 of the data converter 1. That is to say, when the data converter 1 is called for the first time the lamp operating means 4.1 is assigned at least one group address, and when the data converter 1 is called for the second time the lamp operating means 4.2 is assigned at least one group address, and so on until all sixty-four lamp operating means 4.1 to 4.64 are provided with group addresses. In this process, the data converter 1 uses the above rule to pass on to the second lamp operating means 4.1 to 4.64 the group addresses it has been given by the central control device 2. The individual lamp operating means 3.1 to 3.63 and 4.1 to 4.64 store the group addresses assigned to them in a nonvolatile storing means, for example in an EEPROM. It is also possible in this way for the lamp operating means 4.1 to 4.64 connected to the data output 13 of the data converter 1 to be divided into groups. It is even possible for the first lamp operating means 3.1 to 3.63 and second lamp operating means 4.1 to 4.64 to be combined in the same group.

If, for example, the first group of lamp operating means comprises the lamp operating means 3.1, 4.1 and 4.2, a control command specific to this group of lamp operating means is sent from the central control device 2 to all the first lamp operating means 3.1 to 3.63 via the control output 21, and to all the second lamp operating means 4.1 to 4.64 via the data converter 1. However, only the lamp operating means 3.1, 4.1 and 4.2 will execute this control command, since only the group address stored by these lamp operating means 3.1, 4.1 and 4.2 correspond to the group address specified in the control command. The data converter 1 operates in this case like a slave, that is to say it passes on the control command to the lamp operating means 4.1 to 4.64 connected at its data output 13.

By contrast, with reference to the lamp operating means 4.1 to 4.64 connected to its data output 0.13 the data converter 1 operates like a master, that is to say, for example, acknowledgements of the second lamp operating means 4.1 to 4.64 relating to their current status in response to corresponding queries from the central control device 2 are evaluated by the data converter 1 and not by the central control device 2. The central control device 2 evaluates corresponding acknowledgements of the first lamp operating means 3.1 to 3.63. By cyclically interrogating the lamp operating means 4.1 to 4.64 downstream of it, the data converter 1 automatically carries out status monitoring of these lamp operating means. This status indication can be used by the data converter 1 to answer queries from the central control device 2 immediately, without a time delay. It is not possible for queries from the central control device 2 to be passed on to the lamp operating means downstream of the data converter 1, because the time interval between a query from the central control device 2 and the generation of a corresponding acknowledgement of the lamp operating means 4.1 to 4.64 is so large that it is impossible to observe the maximum time interval permissible in accordance with the DALI standard between the query and the arrival of the acknowledgement.

The data converter 1 is preset to the first operating mode. In order to put it into the second operating mode, it must be switched over into the latter by actuating a switch arranged on the housing of the data converter 1, or by means of a special command of the central control device 2. The actuation of this switch, or the abovenamed command, initiates the start-up procedure explained above.

The data converter 1 is configured in such a way that it can receive and evaluate both digital and analog control signals at its data input 12. Instead of the central control device 2 illustrated schematically in FIG. 2, which operates in accordance with the standardized DALI protocol and applies digital control commands to the data input 12 of the data converter 1, it is also possible to use a central control device that operates with analog control commands, for example a pushbutton 5 in accordance with the schematic illustration in FIG. 3.

The data input 12 of the data converter 1 is connected to the AC supply voltage N, L via the pushbutton 5. A total of sixty-four parallel-connected lamp operating means 6.1 to 6.64 are connected to the data output 13 of the data converter 1. The connection of the data input 12 to the AC supply voltage is made and broken by actuating the pushbutton 5. Control commands for the lamp operating means 6.1 to 6.64 connected to the data output 13 are generated by the evaluation unit 14 as a function of actuation of the pushbutton 5, the duration of the pushbutton actuation and the instantaneous operating state of the lamp operating means 6.1 to 6.64. All the lamp operating means 6.1 to 6.64 are controlled simultaneously in the same way by means of the pushbutton 5. That is to say, the light-generating means operated by the lamp operating means 6.1 to 6.64 are switched on and off and dimmed simultaneously. The details of the control of the lamp operating means 6.1 to 6.64 by means of a pushbutton 5 are described minutely in WO 01/52607 A1 and are therefore not to be explained further here. Likewise, WO 01/52607 A1 also describes the way to distinguish between analog and digital control signals. The data converter 1 distinguishes digital and analog control signals at its data output 12 in the same way as in the Offenlegungsschrift cited above.

What is claimed is:

1. A method of operating a lighting system comprising the steps of providing a central control device having a control output connected to first lamp operating means and to a data input of a data converter whereby control signals generated by the central control device are received by the data converter and by the first lamp operating means, the data converter having a data output connected to second lamp operating means, evaluating the control signals from the central control device and converting into commands for controlling the second lamp operating means as a function of an evaluation of the control signals by the data converter.

2. The method as claimed in claim 1, wherein at least two different operating modes of said data converter are provided.

3. The method as claimed in claim 2, wherein in accordance with a first operating mode the data converter converts the control signals received from the central control device into similar commands for all the lamp operating means monitored by said data converter.

4. The method as claimed in claim 3, wherein the data converter evaluates both digital data and analog control signals of the central control device and converts them into commands for the lamp operating means monitored by said data converter.

5. The method as claimed in claim 1, wherein the grouping of the lamp operating means is defined during a start-up phase of the lighting system.

6. The method as claimed in claim 5, wherein during the start-up phase a start-up procedure of the data converter is started in order to provide address codes to the lamp operating means monitored by said data converter, and subsequently a start-up procedure of the central control device is started in order to provide address codes to said data converter and any lamp operating means directly monitored by said central control device, the data converter being selected by the central control device, for grouping the lamp operating means monitored by the data converter, until all the lamp operating means monitored by the data converter are divided into groups, and upon each selection by the data converter a lamp operating means monitored by said data converter being successively assigned to a group of lamp operating means.

7. The method as claimed in claim 1, wherein the data converter automatically carries out a status monitoring of the lamp operating means connected to its data output.

8. The method as claimed in claim 7, wherein said status monitoring of the lamp operating means is carried out cyclically at regular time intervals.

9. The method as claimed in claim 7, wherein the data converter answers queries from the central control device concerning the status of the lamp operating means for the lamp operating means connected to said data output.

10. The method as claimed in claim 9, wherein the data converter answers queries from the central control device concerning the properties of the lamp operating means for the lamp operating means connected to said data output with a prescribed standard value for the respective interrogated property of said lamp operating means when the lamp operating means differ from one another with reference to the respective interrogated property.

11. The method as claimed in claim 9, wherein the data converter answers queries from the central control device concerning the properties of the lamp operating means for the lamp operating means connected to said data output with a reference value for the respective interrogated property when said lamp operating means are identical with respect to the respective interrogated property, the data converter using as reference value the value of the respective interrogated property of a lamp operating means, selected by the data converter, of the lamp operating means connected to said data output.

* * * * *